US011235193B1

(12) United States Patent
McConachie et al.

(10) Patent No.: US 11,235,193 B1
(45) Date of Patent: Feb. 1, 2022

(54) RESISTANCE SYSTEM AND METHODS THEREOF

(71) Applicant: University of Tennessee Research Foundation, Knoxville, TN (US)

(72) Inventors: Kelsey Ann McConachie, Clarksville, TN (US); Isaac Robert Nolan, Clinton, TN (US); Thao Nguyen Strong, Johnson City, TN (US); Ryan Joseph Tinker, Sevierville, TN (US)

(73) Assignee: University of Tennessee Research Foundation, Knoxville, TN (US)

( * ) Notice: Subject to any disclaimer, the term of this patent is extended or adjusted under 35 U.S.C. 154(b) by 123 days.

(21) Appl. No.: 16/406,748

(22) Filed: May 8, 2019

Related U.S. Application Data

(60) Provisional application No. 62/668,344, filed on May 8, 2018.

(51) Int. Cl.
*A63B 21/00* (2006.01)
*A63B 21/005* (2006.01)
*A63B 69/12* (2006.01)

(52) U.S. Cl.
CPC ..... *A63B 21/153* (2013.01); *A63B 21/0058* (2013.01); *A63B 21/4009* (2015.10); *A63B 69/12* (2013.01)

(58) Field of Classification Search
CPC ..... A63B 21/153; A63B 21/4009; A63B 21/0058; A63B 69/12
See application file for complete search history.

(56) References Cited

U.S. PATENT DOCUMENTS 1,795,066 A * 3/1931 Woop ..... A63B 69/12 472/13
3,512,416 A * 5/1970 Hohwart ..... A63B 69/12 73/379.09
3,861,675 A * 1/1975 Hopper ..... A63B 69/12 482/55
4,114,874 A * 9/1978 Mattila ..... A63B 21/015 188/82.77
5,391,080 A * 2/1995 Bernacki ..... A63B 69/12 434/254
5,813,945 A * 9/1998 Bernacki ..... A63B 21/153 434/247
5,938,565 A * 8/1999 Bernacki ..... A63B 21/153 434/247

(Continued)

OTHER PUBLICATIONS

1080 Sprint, "Speed Training Without Compromise," 1080Motion, https://1080motion.com/products/1080-sprint/, pp. 1-7, retrieved online on May 8, 2019.

(Continued)

*Primary Examiner* — Sundhara M Ganesan
(74) *Attorney, Agent, or Firm* — Jenkins, Wilson, Taylor & Hunt, P.A.

(57) ABSTRACT

A resistance system is disclosed. The resistance system has a line reel system for deploying a tension line and a power system for drawing in the slack line. The resistance value can be set by a subject using the device by using a resistance controller and indicator located on an outer surface of the system. The system can be self-contained with an internal power supply. The system is particularly useful for swim training or rehabilitation. It can be simply operated by a user without removing the device.

16 Claims, 4 Drawing Sheets

(56) References Cited

U.S. PATENT DOCUMENTS

| | | | | |
|---|---|---|---|---|
| 9,067,121 | B1 * | 6/2015 | Beard | A63B 71/0622 |
| 2007/0060452 | A1 * | 3/2007 | Chang | A63B 69/12 482/55 |
| 2008/0028510 | A1 * | 2/2008 | Chang | A63B 69/12 4/496 |
| 2010/0197467 | A1 * | 8/2010 | Hector | A63B 69/12 482/55 |
| 2010/0285930 | A1 * | 11/2010 | Tedhams | A63B 69/12 482/55 |
| 2012/0264574 | A1 * | 10/2012 | Chang | A63B 71/0009 482/55 |
| 2014/0171270 | A1 * | 6/2014 | Frolov | A61H 33/6005 482/55 |
| 2015/0290517 | A1 * | 10/2015 | Saleh | A63B 69/12 434/254 |
| 2016/0016046 | A1 * | 1/2016 | Reese | A63B 21/0084 482/55 |
| 2017/0157486 | A1 * | 6/2017 | Chuang | A63B 21/4009 |
| 2017/0296895 | A1 * | 10/2017 | Greenland | A63B 69/12 |
| 2018/0372170 | A1 * | 12/2018 | Kiselev | A63B 21/151 |

OTHER PUBLICATIONS

Power Tower, Total Performance Inc, https://www.tpiswim.com/power-tower, p. 1, retrieved online on Sep. 15, 2020.

Power Rack, Total Performance Inc, https://www.tpiswim.com/power-rack, pp. 1-2, retrieved online on Sep. 15, 2020.

* cited by examiner

RESISTANCE SYSTEM AND METHODS THEREOF

RELATED APPLICATIONS

This application claims priority to and the benefit of U.S. Provisional Patent Application Ser. No. 62/668,344, filed on May 8, 2018, the disclosure of which is incorporated herein by reference in its entirety.

TECHNICAL FIELD

The presently disclosed subject matter relates to systems and methods for assistance in physical training or rehabilitation. In particular, the presently disclosed subject matter relates to swim training.

BACKGROUND

In the sport of competitive swimming, athletes often seek ways to increase their strength conditioning while training in the water. One such approach is to swim against a resistance, which requires more effort than free swimming. Some examples of existing systems include water bucket or weight pulley systems, and motorized systems.

Each of these systems has drawbacks. For example, water bucket and metal weight systems are typically arranged in a rack and move upward as a swimmer moves away from the device, similar to conventional land-based weight training machines. These systems can be a bulky size that makes repositioning or storage difficult, as well as interfering with movement around the pool deck and limiting the number of swimmers per lane. Additionally, the length of available travel can be limited based on factors such as ceiling height or line length. Moreover, weight-bases systems are susceptible to corrosion in the pool environment. Motorized systems, which are typically smaller and provide training data, can also be complex to maintain and operate, and in some cases can be cost-prohibitive. Thus, there is an ongoing need for a swimming resistance system that is smaller, simpler to operate, and less expensive than conventional systems.

SUMMARY

Provided in accordance with the presently disclosed subject matter is a portable resistance system. In some embodiments, the presently disclosed system comprises a power system and a line reel system, where the line reel system is connected to the power system by a power transfer device. A tension line is attached to a line reel and to a subject. A resistance indicator is disposed on an outer surface of the system, and a force required to deploy the tension line is controlled by the resistance controller. The power transfer device automatically retracts the tension line when tension is released from the tension line.

In some embodiments, the resistance controller is operated by a subject in a swimming pool, without exiting the swimming pool, and the resistance indicator is disposed on a side of the system facing the swimming pool.

In some embodiments, the system comprises a mounting bracket, which is configured for releasably attaching the system to an existing fixture, such as a dive platform.

In some embodiments, the systems are configured such that two or more systems can be mounted in several adjacent swim lanes.

In some embodiments, the line reel is configured to deploy the tension line in a direction perpendicular to a direction of movement by the subject.

In some embodiments, the power source is a battery enclosed in a housing of the system. In some embodiments, the power transfer device is a motor, and an output shaft of the motor is connected to an input shaft of the line reel system by a pulley system.

In some embodiments, the power transfer device is operated by a switch, which is connected to the power transfer device and to the tension line.

Accordingly, it is an object of the presently disclosed subject matter to provide resistance systems and methods of providing resistance to a subject. This and other objects are achieved in whole or in part by the presently disclosed subject matter.

An object of the presently disclosed subject matter having been stated above, other objects and advantages of the presently disclosed subject matter will become apparent to those of ordinary skill in the art after a study of the following description of the presently disclosed subject matter and non-limiting Figures and Examples.

DETAILED DESCRIPTION

Figure 1:
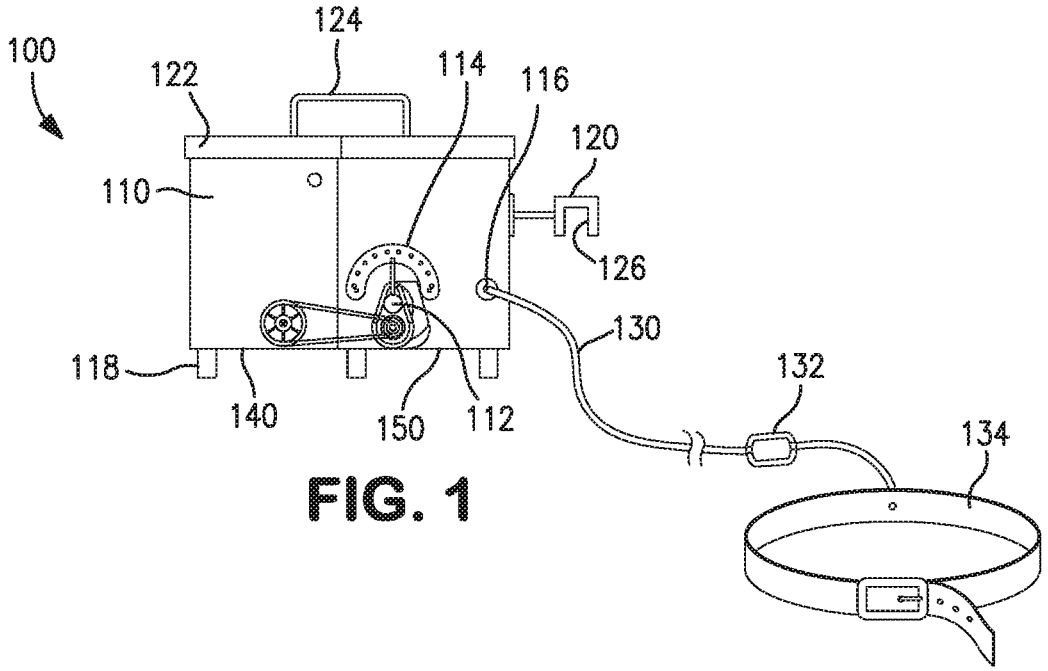
FIG. 1 is a front elevation view of an embodiment of a resistance system as disclosed herein.

In some embodiments, the presently disclosed subject matter addresses obstacles to effective training methods for competitive swimmers, as well as improvements to recreational swimming as an exercise. However, the presently disclosed subject matter can be employed in any setting where providing resistance to a subject as desired, such as but not limited to training for other athletic endeavors and rehabilitation settings.

Swimming programs often utilize some sort of system to assist in training swimmers in order to optimize performance. When implemented in swim training, the presently disclosed system is designed to enhance the swim strength of swimmers, which is useful as swimmers train for competitions. Improved qualities of the system include, but are not limited to, the size of the system, the resistance, the minimum distance a swimmer travels, and the practice time for swimmers. The presently disclosed system is also relatively low cost and easy to maintain compared to existing systems. It is also envisioned that the swimming resistance system disclosed herein could be applicable as a training device for other sports, such as running, skating, skiing, or any other sport that would benefit from resistance to forward motion. It is further envisioned that, in addition to athletic training, the swimming resistance system can be used in physical rehabilitation for humans and animals.

The presently disclosed subject matter will now be described more fully hereinafter with reference to the accompanying Figures, in which representative embodiments are shown. The presently disclosed subject matter can, however, be embodied in different forms and should not be construed as limited to the embodiments set forth herein. Rather, these embodiments are provided so that this disclosure will be thorough and complete, and will fully convey the scope of the embodiments to those skilled in the art. Certain components in the Figures are not necessarily to scale, emphasis instead being placed upon illustrating the principles of the presently disclosed subject matter (in some cases schematically).

Unless otherwise defined, all technical and scientific terms used herein have the same meaning as commonly understood by one of ordinary skill in the art to which this presently described subject matter belongs. All publications, patent applications, patents, and other references mentioned herein are incorporated by reference in their entirety.

While the following terms are believed to be well understood by one of ordinary skill in the art, the following definitions are set forth to facilitate explanation of the presently claimed subject matter.

Following long-standing patent law convention, the terms "a", "an", and "the" refer to "one or more" when used herein, including in the claims.

As used herein, the term "about", when referring to a value or an amount, for example, relative to another measure, is meant to encompass variations of in some embodiments ±20%, in some embodiments ±10%, in some embodiments ±5%, in some embodiments ±1%, and in some embodiments ±0.1% from the specified value or amount, as such variations are appropriate. The term "about" can be applied to all values set forth herein.

As used herein, the term "and/or" when used in the context of a listing of entities, refers to the entities being present singly or in combination. Thus, for example, the phrase "A, B, C, and/or D" includes A, B, C, and D individually, but also includes any and all combinations and sub-combinations of A, B, C, and D.

The term "comprising", which is synonymous with "including," "containing," or "characterized by" is inclusive or open-ended and does not exclude additional, unrecited elements or method steps. "Comprising" is a term of art used in claim language which means that the named elements are present, but other elements can be added and still form a construct or method within the scope of the claim.

As used herein, the phrase "consisting of" excludes any element, step, or ingredient not specified in the claim. When the phrase "consists of" appears in a clause of the body of a claim, rather than immediately following the preamble, it limits only the element set forth in that clause; other elements are not excluded from the claim as a whole.

As used herein, the phrase "consisting essentially of" limits the scope of a claim to the specified materials or steps, plus those that do not materially affect the basic and novel characteristic(s) of the claimed subject matter.

With respect to the terms "comprising", "consisting of", and "consisting essentially of", where one of these three terms is used herein, the presently disclosed and claimed subject matter can include the use of either of the other two terms.

As used herein, "significance" or "significant" relates to a statistical analysis of the probability that there is a non-random association between two or more entities. To determine whether or not a relationship is "significant" or has "significance", statistical manipulations of the data can be performed to calculate a probability, expressed in some embodiments as a "p-value". Those p-values that fall below a user-defined cutoff point are regarded as significant. In some embodiments, a p-value less than or equal to 0.05, in some embodiments less than 0.01, in some embodiments less than 0.005, and in some embodiments less than 0.001, are regarded as significant.

In some embodiments, the designated subject according to the presently disclosed subject matter is a human subject, although it is to be understood that the methods described herein can be effective with respect to animals.

In some embodiments the presently disclosed subject matter provides a system configured to provide resistance against a swimmer, for use in a swimming pool environment. The system can be mounted on the edge of the pool at the end of a swim lane. The system comprises a lightweight tether or "tension" line, which is attached to the swimmer. The tension line is retractable, and a feed device for the tension line is housed in a sealed case. The feed device also controls the resistance to deployment of the line. The resistance can be easily increased or decreased as required for the individual swimmer by way of an adjustment controller on the front of the device. The system maintains a substantially constant pull resistance over the length of a standard swim lane (typically 25 meters to 50 meters, or approximately 82 feet to 164 feet). As the swimmer reaches the far end of the swim lane and turns to return to the starting point, the system will automatically begin to retract the tension line into the housing. The swimmer can remain connected to the tension line while returning.

One advantage of the swimming resistance system disclosed herein is that the system is small and can be removably mounted to existing poolside features. Additionally, unlike many conventional systems, the presently disclosed swimming resistance system can be quickly and easily adjusted by the swimmer without assistance. It is not necessary to remove the tension line or to get out of the water to change the resistance setting. The resistance controls are located on a front side of the system so that it is accessible to the swimmer at the edge of the pool. Compared to conventional systems that require exiting the pool to change the resistance, this improvement is not only faster, but also much easier and less demanding of the swimmers. Particularly in a team setting where there may be multiple swimmers working on different types of swim drills, the ability to change the resistance from the water greatly reduces the amount of time required to make changes. This eliminates the need to move weights as required by the current pulley systems, and it is not necessary for a second person to be available to assist.

Referring to FIG. 1, a non-limiting representative example embodiment of a resistance system, generally designated 100, is illustrated. Resistance system 100 includes a housing 110. Housing 110 comprises two portions: a power system 140 and a line reel system 150. A tension line 130 is deployed through a feed exit 116. The line tension is controlled by a resistance controller 112, and the selected resistance displayed on a resistance indicator 114. In the example embodiment of FIG. 1, resistance system 100 additionally comprises optional features including feet 118, a mounting bracket 120, a lid 122, and a handle 124.

Aquatic center environments frequently have high humidity and chemically-treated water, which can lead to damage and corrosion, and therefore housing 110 can be configured as a sealed box in order to protect the feed and retraction mechanisms housed within. For example, housing 110 can be formed from aluminum, stainless steel, or molded plastic. Resistance controller 112 and feed exit 116 can also be formed with moderately or fully water-tight opening to resist water ingress into housing 110. In some embodiments, any or all openings formed in housing 110 for resistance controller 112, feed exit 116, or other openings, can include sealing gaskets.

Tension line 130 can be connected to the subject by any suitable method, such as a belt 134, and can include optional safety and/or convenience features such as clip 132. Tension line 130 is preferably a small-diameter, high-strength line. In a preferred embodiment, tension line 130 is a braided nylon line such as that used for fishing. In a further preferred embodiment, tension line 130 has a strength of 80 pounds (lbs) or greater. Typically, the strength of a line is proportional to the diameter. By using a thin but strong cord, tension line 130 requires less storage space than larger lines and allows housing 110 to be compact and lightweight. Additionally, the thin cord could be less noticeable to a subject than a conventional rope or strap. Less storage space can in turn allow a longer line to be used, increasing a possible distance of travel by the subject. In some embodiments, it is possible for line 130 to have a length of approximately 300-400 meters. In some embodiments, line 130 can be interchangeable in line reel system 150 depending on the usage application.

Figure 2:
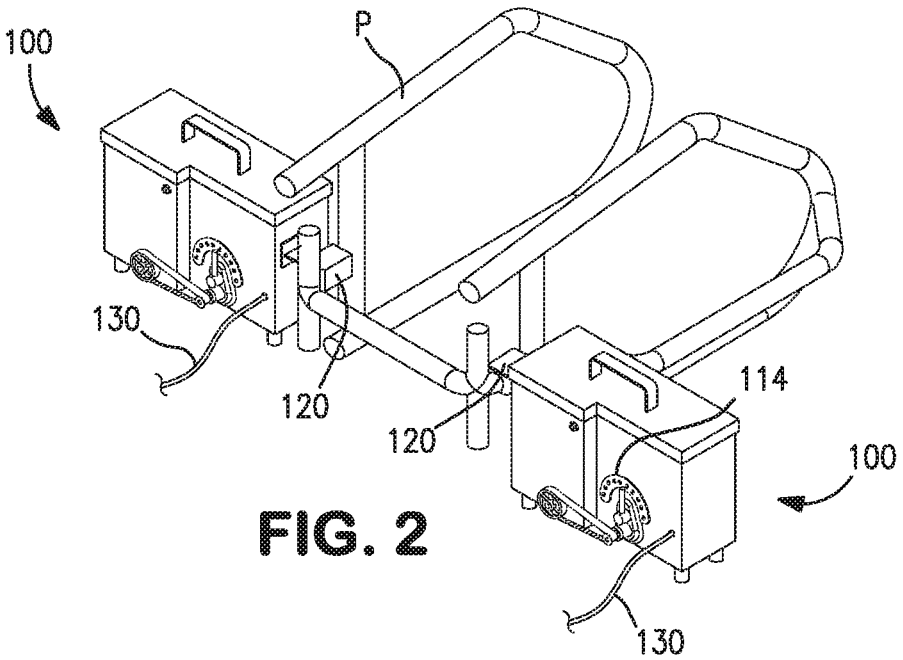
FIG. 2 is an isometric view of two installed resistance systems as disclosed herein.
Figure 3A:
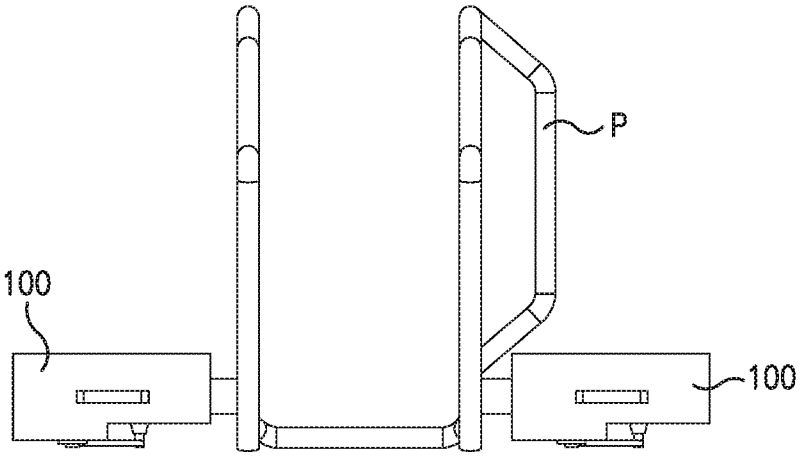
FIGS. 3A-3C are elevation views of the embodiment of the resistance system of FIG. 2.
Figure 3B:
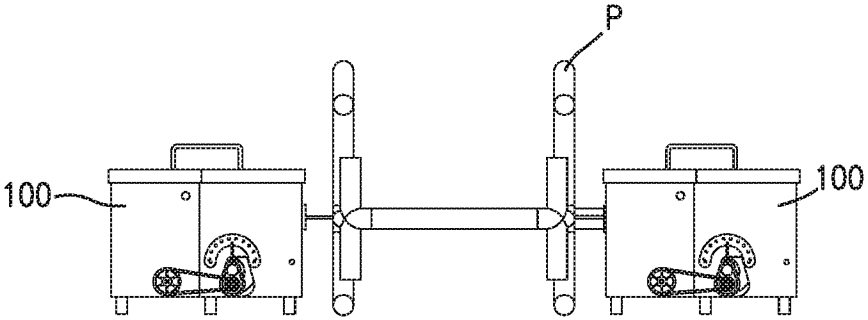
Figure 3C:
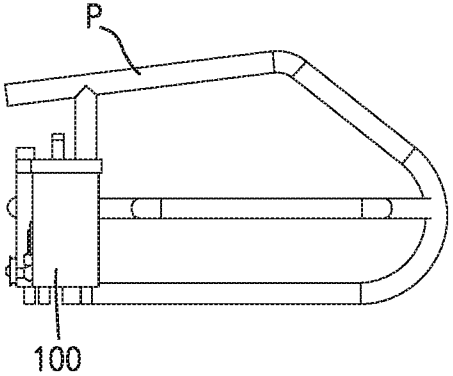

Referring to FIGS. 2 and 3A-3C, an installation of two resistance systems 100 in a swim training setting is shown. Mounting bracket 120 can be mounted on either side of housing 110, which allows at least two resistance systems 100 to be used in a single swim lane, in the case of use in a swim training setting. A standard swim lane is typically 8.2 feet (2.5 meters) wide. Further, the compact size of resistance system 100 allows the use of multiple systems over multiple adjacent swim lanes, expanding the number of possible users. In the embodiment of FIG. 2, mounting bracket 120 is configured to be connected to the framework of a dive platform P. For clarity, platform P is illustrated without the diving surface. This eliminates the need for racks or other specific mounting features that occupy space on the pool deck. Mounting bracket 120 can be formed to fit between upright portions of the framework, and mounting bracket 120 can have sufficient stiffness and depth to resist twisting or lifting of resistance system 100. Optionally, an inner surface of mounting bracket 120 can be covered a resilient material 126 (see FIG. 1). Resilient material 126 can be of any suitable material such as rubber, plastic, foam, etc. This can improve the fit of the bracket and prevent damage to the attachment surface. Mounting bracket 120 can further be configured to either rest over or latch onto platform P. In some embodiments, mounting bracket 120 is removable and reversible such that it can be mounted on either side of housing 110. This allows resistance system 100 to advantageously be mounted on either side of existing pool structures. It is noted that a person of ordinary skill in the art will recognize that other attachment methods, fixtures, locations, etc. are also possible for mounting fixture 120 without departing from the disclosure. In the example embodiment of FIG. 2, resistance indicator 114 is disposed on an outer surface of system 100 that faces the swim lane. This allows the user to adjust the resistance values while remaining in the water and connected to line 130.

Another advantage of resistance system 100 is portability. In a preferred embodiment, resistance system 100 can be approximately or less than 18 inches (in.) wide, 8 inches deep, and 12 inches tall. The weight of resistance system 100 is within a range that a single person can lift it without assistance using handle 124.

Figure 4C:
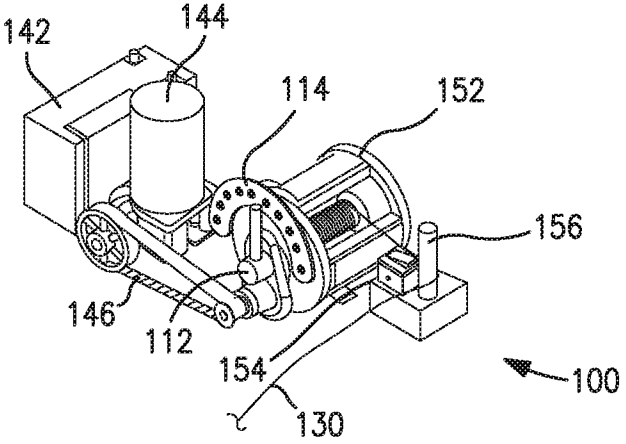
FIGS. 4A-4C are detail views of the power and line reel systems of the resistance system disclosed herein.
Figure 4A:
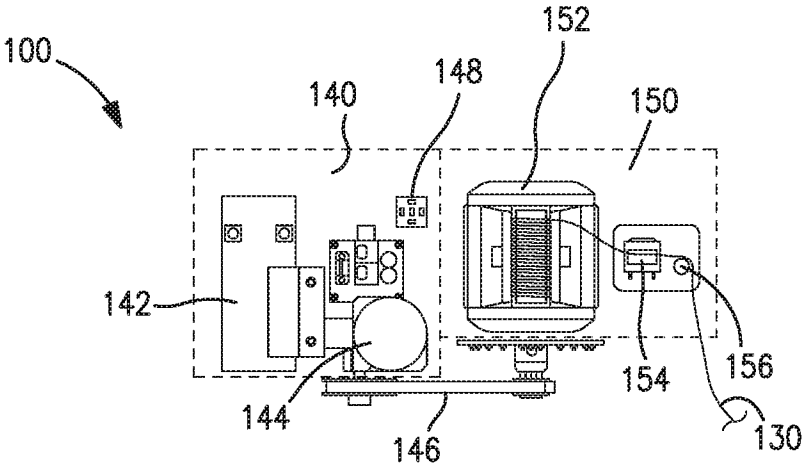
Figure 4B:
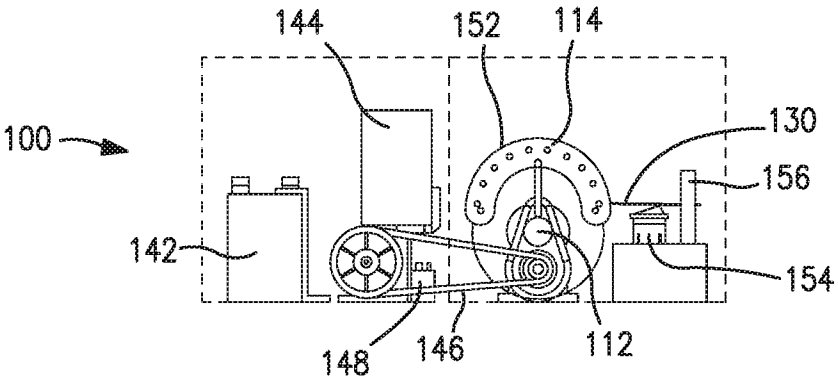

Referring now to FIGS. 4A-4C, a representative mechanism of resistance system 100 is illustrated. Inside housing 110 are two chambers: a power supply system 140 and a line supply system 150. The two systems can be housed in two separate chambers of swimming resistance system 100. The two-chamber configuration is a safety feature that can limit damage in the event of a power source failure or water ingress, but it is not strictly necessary. Power system 140 houses a power supply 142. Power supply 142 is preferably a battery, which allows the system to be self-contained and eliminates the need for an outside power source. Alternately, power supply 142 can be a conventional electrical power supply such as a 12V DC power supply. Power system 140 can additionally be equipped with a power entry module (not shown), through which power supply 142 can be connected to an outside power source. In the case where power supply 142 is a battery, the power entry module can be used to maintain and charge the battery as needed. Power system 140 can further optionally include conventional features such as safety fuses and a power interrupt switch (see, e.g., power switch 168, FIG. 5), which can be used during storage or in case of system failure to turn off the device.

Power supply 142 drives a motor 144, which is used to rewind line 130 when tension is released from the line (e.g., as the swimmer swims toward resistance system 100). Motor 144 is in communication with a line reel 152. Although various configurations are possible, the embodiment of FIG. 3 is accomplished by way of a belt and gear pulley system 146, which is connected between an output shaft of motor 144 and an input shaft of line reel 152. In particular, in the example embodiment of resistance system 100, pulley system 146 uses a tooth belt and timing pulley. In a particular exemplary embodiment, the pulley on the output shaft of motor 144 has 60 teeth, and the pulley on the input shaft of line reel 152 has 20 teeth. Pulley system 146 transfers motion from the output shaft to the input shaft at a 3:1 ratio, although other ratios are possible as would be apparent to one of ordinary skill in the art upon a review of the instant disclosure In some embodiments, line reel 152 is a "fishing reel" type line reel. Line 130 unwinds from line reel 152 as tension is applied to the line. Tension is applied, for example, when the line is attached to the swimmer by belt 134 and the swimmer begins swimming away from system 100. The force required to unwind line 130 is controlled by resistance controller 112. In some embodiments, resistance controller 112 can comprise, for example, a conventional clutch system such as pressure discs used in fishing reels. The resistance can be changed by manually moving controller 112, which can be in the form of a lever or knob. In some embodiments, setting the resistance can be performed by directly setting pressure on the wheel (as opposed to indirectly or electronically setting the resistance). Resistance controller 112 can be set to specific values, which are marked on resistance indicator 114. In some embodiments, resistance controller 112 and line reel 152 can be formed integrally. line reel 152 and controller 112 can also optionally include a calibration mechanism for initial setup of resistance controller 112.

One advantage of the resistance system disclosed herein is its relative simplicity. By using a commercially available fishing reel combined with an enclosed power source and standard motor, the resulting system is robust, is relatively inexpensive, and requires little maintenance. Fishing reel systems are designed for use in wet and/or salty environments and often have seals to protect the internal clutch system. The power source and motor can be provided as readily available, replaceable parts.

In a preferred embodiment, the resistance values are in the range of approximately 3 lbs-28 lbs. This range permits users to select a resistance appropriate for their weight, strength, training regimen, etc. Other resistance values outside this range are also possible. An advantage of resistance system 100 over existing gravity-based weight systems is that the resistance value is substantially constant over the entire length of the swim lane or other setting in which system 100 is deployed. Competitive swimming lanes are typically 25-50 meters long and 2.5 meters wide. Swimmers will be able to attach to the system and input a particular resistance that will be consistent throughout their swim. The resistance value can also be easily adjusted by swimmer without removing the line.

The operation of the retrieval system will now be described. When tension is applied to line 130, line 130 spools out from line reel 152 according to the set resistance value. In other words, the set resistance value is equal to the force required to pull out line 130. On the exit side of line reel 152, line 130 is in contact with a normally-closed switch 154, which acts as a tension switch. Tension line 130 then passes through a direction-changing device as needed in order to exit through feed exit 116. By way of example and not limitation, the embodiment of FIGS. 4A-4C, line reel 152 is arranged such that line 130 leaves the reel in a direction perpendicular to the direction of swim travel. The direction-changing device is a cylinder 156, and line 130 makes a 90 degree turn around cylinder 156. The direction-changing device can also be formed by other methods. For example, it can be formed in multiple parts, such as two sequential rollers that create two 45 degree bends in line 130. Other configurations would also be apparent to one of ordinary skill in the art upon a review of the instant disclosure. Feed exit 116 can also be provided with features that facilitate smooth line movement, such as rollers or bushings (not shown). The tension in line 130 holds switch 154 open. Motor 144 is operated by switch 154 and remains powered off as long as there is tension on line 130. When the swimmer is ready to return to the starting position and the tension is released on line 130, line 130 becomes slack. Switch 154 then closes and motor 144 powers on and draws in the slack line. If line 130 becomes taut again, motor 144 will again power off.

Figure 5:
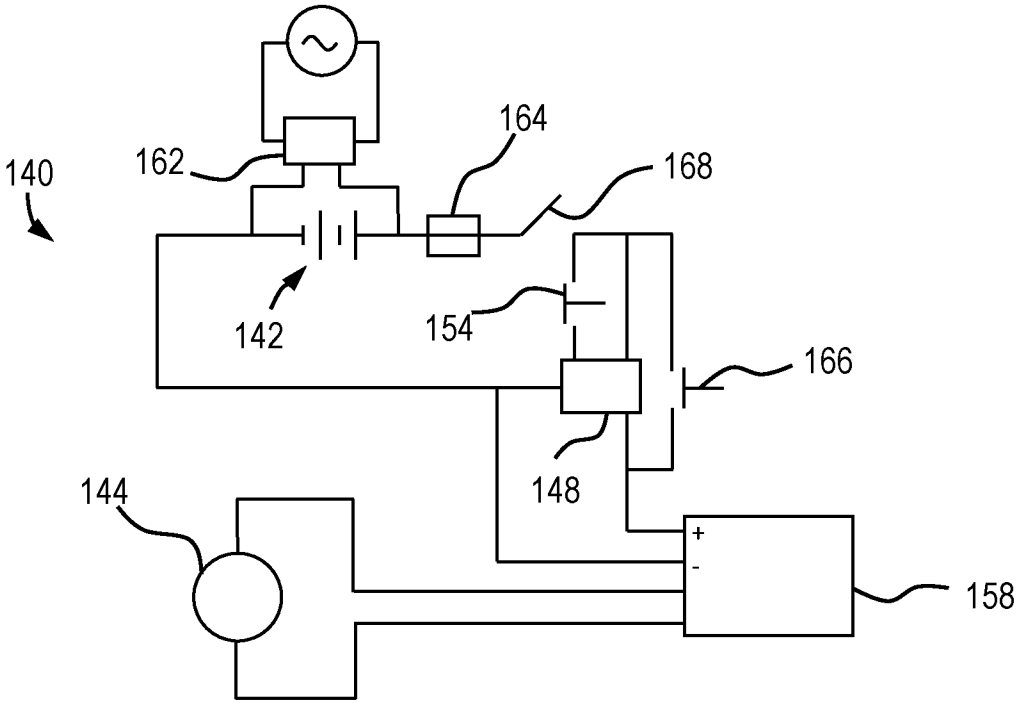
FIG. 5 is a wiring diagram of an embodiment of a resistance system as disclosed herein.

Referring to FIG. 5, an example wiring diagram of power system 140 is illustrated. Power system 140 has a battery 142, which is coupled to a float charger 162. Float charger 162 maintains battery 142 and provides charge when battery 142 is connected to a 110V alternating current (AC) power source and when battery 142 is below operating voltage. Safety features power-interrupt switch 168 and fuse 164 are also located near battery 142. Tension switch 154 is connected to motor 144 through a relay 148. Motor 144 can also be operated with an optional by-pass switch 166, which can be used for setup and troubleshooting. Motor 144 is additionally be equipped with a speed controller 158 to which relay 148 and by-pass switch 166 are connected. Speed controller 158 can be, for example, a potentiometer that changes the input voltage to motor 144. In a representative embodiment, power system 140 draws approximately 6.2 amps and has a 7.5 amp fuse.

It will be understood that various details of the presently disclosed subject matter can be changed without departing from the scope of the presently disclosed subject matter. Furthermore, the foregoing description is for the purpose of illustration only, and not for the purpose of limitation.

What is claimed is:

1. A portable resistance system, comprising:

a power system having a power source and a power transfer device;

a line reel system having a line reel and a resistance controller, wherein the line reel system is connected to the power system by the power transfer device;

a tension line attached at one end to the line reel and configured to attach to a subject at an opposite end;

a switch connected to the power transfer device and to the tension line; and a resistance indicator disposed on an outer surface of the system, wherein a resistance force required to deploy the tension line is controlled by the resistance controller, wherein the switch is configured to activate the power transfer device to automatically retract the tension line when tension is released from the tension line and to deactivate the power transfer device when tension is applied to the tension line; and wherein the power transfer device is a motor, and wherein an output shaft of the motor is connected to an input shaft of the line reel system by a pulley system.

2. The system of claim 1, wherein the resistance controller is configured to be operated by the subject in a swimming pool, without exiting the swimming pool, and wherein the resistance indicator is disposed on a side of the system facing the swimming pool.

3. The system of claim 1, comprising a mounting bracket, wherein the mounting bracket is configured for releasably attaching the system to an existing fixture.

4. The system of claim 3, wherein the fixture is a dive platform.

5. The system of claim 4, wherein the systems are configured such that two or more systems can be mounted in each of a plurality of swim lanes.

6. The system of claim 1, wherein the line reel is configured to deploy the tension line in a direction perpendicular to a direction of movement by the subject.

7. The system of claim 1, wherein the power source comprises a battery enclosed in a housing of the system.

8. The system of claim 1, wherein a rotational speed of the output shaft is controlled by a speed controller.

9. The system of claim 1, wherein the line reel system provides a resistance force in the range of approximately 3 lbs to 28 lbs.

10. The system of claim 1, wherein the resistance force is substantially constant over a distance of at least 25 meters.

11. A method for applying resistance to a subject, the method comprising:

providing at least one system according to claim 1;

attaching the tension line to a subject;

spooling out the tension line as the subject applies tension to the tension line; and automatically retracting the tension line using the power system when tension is released from the tension line.

12. The method of claim 11, wherein the resistance force is substantially constant over a tension line length of at least 25 meters, and wherein the resistance force is in the range of approximately 3 lbs to 28 lbs.

13. The method of claim 11, wherein the resistance is applied to the subject for physical rehabilitation.

14. The method of claim 11, comprising releasably attaching the system to a dive platform of a swimming pool, for use with a swimming subject.

15. The method of claim 14, comprising setting the resistance force by the subject without exiting the swimming pool.

16. The method of claim 14, comprising providing a plurality of portable resistance systems in each of a plurality of swim lanes.

* * * * *